US008970466B2

(12) United States Patent
Lee et al.

(10) Patent No.: US 8,970,466 B2
(45) Date of Patent: Mar. 3, 2015

(54) TIMING CONTROLLER, DISPLAY DEVICE USING THE SAME, AND METHOD FOR DRIVING TIMING CONTROLLER

(75) Inventors: Songjae Lee, Gyeonggi-do (KR); Youngho Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 600 days.

(21) Appl. No.: 13/239,691

(22) Filed: Sep. 22, 2011

(65) Prior Publication Data

US 2012/0146980 A1 Jun. 14, 2012

(30) Foreign Application Priority Data

Dec. 13, 2010 (KR) ..... 10-2010-0126786

(51) Int. Cl.
*G09G 3/20* (2006.01)
*G09G 5/00* (2006.01)

(52) U.S. Cl.
CPC ..... *G09G 3/2096* (2013.01); *G09G 5/008* (2013.01); *G09G 2310/08* (2013.01)
USPC ..... 345/99; 345/87; 345/100; 345/204; 345/211; 345/690

(58) Field of Classification Search
USPC ..... 345/211, 204, 100, 87
See application file for complete search history.

(56) References Cited

U.S. PATENT DOCUMENTS

| | | | | |
|---|---|---|---|---|
| 6,316,974 | B1 * | 11/2001 | Taraci et al. | 327/147 |
| 2007/0097263 | A1 * | 5/2007 | Kim | 348/521 |
| 2009/0096769 | A1 * | 4/2009 | Kim et al. | 345/204 |
| 2009/0160845 | A1 * | 6/2009 | Jang et al. | 345/214 |
| 2012/0026156 | A1 * | 2/2012 | Chen et al. | 345/214 |

FOREIGN PATENT DOCUMENTS

| | | |
|---|---|---|
| CN | 101409057 | 4/2009 |
| CN | 101465103 | 6/2009 |

OTHER PUBLICATIONS

Chinese Office Action dated Dec. 18, 2013 for corresponding Patent Application No. 20110345964.6.

* cited by examiner

*Primary Examiner* — Grant Sitta
(74) *Attorney, Agent, or Firm* — Morgan, Lewis & Bockius LLP

(57) ABSTRACT

A timing controller, a display device using the timing controller, and a method for driving the timing controller are discussed. The timing controller includes a frequency change sensing unit, that measures a length of an (n−1)th frame period and a length of an nth frame period, where n is a natural number equal to or greater than 2, and outputs timing signals of a low logic level when a length difference between the (n−1)th frame period and the nth frame period is greater than a predetermined first threshold value, a scan timing control signal output unit for outputting a scan timing control signal based on the timing signals, and a data timing control signal output unit controlling a data driving circuit based on the timing signals.

13 Claims, 6 Drawing Sheets

TIMING CONTROLLER, DISPLAY DEVICE USING THE SAME, AND METHOD FOR DRIVING TIMING CONTROLLER

This application claims the benefit of Korean Patent Application No. 10-2010-0126786 filed on Dec. 13, 2010, the entire contents of which is incorporated herein by reference for all purposes as if fully set forth herein.

BACKGROUND OF THE INVENTION

1. Field of the Invention

Embodiments of the invention relate to a timing controller, a display device using the timing controller, and a method for driving the timing controller.

2. Discussion of the Related Art

With the development of information society, a demand for various types of display devices for displaying an image is increasing. Various flat panel displays such as a liquid crystal display, a plasma display device, and an organic light emitting diode (OLED) display have been recently used.

A timing controller of the flat panel display receives timing signals such as a clock and a data enable signal from a host system and generates control signals for controlling each of a data driving circuit and a scan driving circuit. The control signals include a scan timing control signal for controlling the scan driving circuit and a data timing control signal for controlling the data driving circuit. The data driving circuit converts RGB data into a data voltage in response to the data timing control signal and outputs the data voltage to data lines of a display panel. The scan driving circuit sequentially supplies a scan pulse synchronized with the data voltage to scan lines (or gate lines) of the display panel in response to the scan timing control signal.

Channel changes, changes in external input mode, conversion between analog signals and digital signals may be generated during a drive of the flat panel display. In the instance, there is a a frequency change of the timing signals input to the timing controller. Because the data enable signal is no longer input to the timing controller when the frequency of the timing signals changes, a corresponding frame, in which the frequency change occurs, ends. Hence, the timing controller generates a start voltage using the timing signals having the changed frequency, and a new frame starts in response to the start voltage. As a result, when the frequency of the timing signals changes, the timing controller generates an abnormal output for controlling the scan driving circuit, so that an image is displayed on only some of first to kth vertical lines during one frame period, where k is 1080 at a resolution of 1920×1080.

SUMMARY OF THE INVENTION

In one aspect, there is a timing controller including a frequency change sensing unit configured to measure a length of an (n−1)th frame period and a length of an nth frame period, where n is a natural number equal to or greater than 2, and output timing signals of a low logic level when a difference between the length of the (n−1)th frame period and the length of the nth frame period is greater than a predetermined first threshold value, a scan timing control signal output unit configured to output a scan timing control signal for controlling a scan driving circuit of a display panel based on the timing signals output from the frequency change sensing unit, and a data timing control signal output unit configured to control a data driving circuit of the display panel and a polarity of a data voltage based on the timing signals received from a host computer. The timing signals include a data enable signal indicating whether or not data having a predetermined frequency exists, a main clock having a predetermined frequency, and an internal clock having a predetermined frequency.

In another aspect, there is a display device including a display panel including data lines and scan lines crossing the data lines, a scan driving circuit configured to sequentially output a scan pulse to the scan lines, a data driving circuit configured to convert digital video data into a data voltage and supply the data voltage to the data lines in synchronization with the scan pulse, and a timing controller configured to control an output timing of the scan driving circuit and an output timing of the data driving circuit. The timing controller includes a frequency change sensing unit configured to measure a length of an (n−1)th frame period and a length of an nth frame period, where n is a natural number equal to or greater than 2, and output timing signals of a low logic level when a difference between the length of the (n−1)th frame period and the length of the nth frame period is greater than a predetermined first threshold value, a scan timing control signal output unit configured to output a scan timing control signal for controlling the scan driving circuit based on the timing signals output from the frequency change sensing unit, and a data timing control signal output unit configured to control the data driving circuit and a polarity of the data voltage based on the timing signals received from a host computer. The timing signals include a data enable signal indicating whether or not data having a predetermined frequency exists, a main clock having a predetermined frequency, and an internal clock having a predetermined frequency.

In yet another aspect, there is a method for driving a timing controller including measuring a length of an (n−1)th frame period and a length of an nth frame period, where n is a natural number equal to or greater than 2, and outputting timing signals of a low logic level when a difference between the length of the (n−1)th frame period and the length of the nth frame period is greater than a predetermined first threshold value, outputting a scan timing control signal for controlling a scan driving circuit of a display panel based on the output timing signals, and controlling a data driving circuit of the display panel and a polarity of a data voltage based on the timing signals received from a host computer. The timing signals include a data enable signal indicating whether or not data having a predetermined frequency exists, a main clock having a predetermined frequency, and an internal clock having a predetermined frequency.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
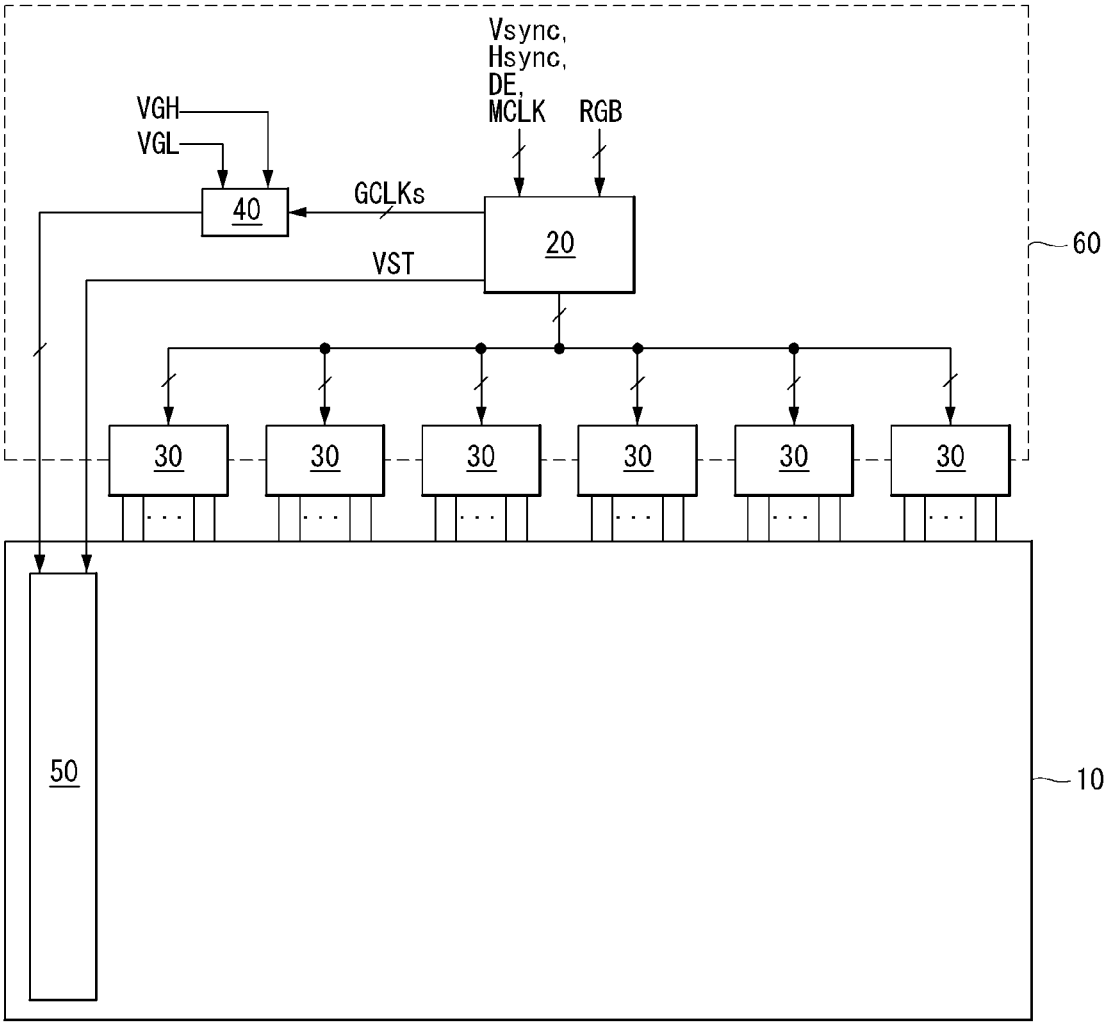
FIG. 1 is a block diagram schematically illustrating a display device according to an example embodiment of the invention.

The invention will be described more fully hereinafter with reference to the accompanying drawings, in which example embodiments of the inventions are shown. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

Names of elements used in the following description may be selected in consideration of facility of specification preparation. Thus, the names of the elements may be different from names of elements used in a real product.

FIG. 1 is a block diagram schematically illustrating a display device according to an example embodiment of the invention. As shown in FIG. 1, the display device according to the example embodiment of the invention includes a display panel 10, a data driving circuit, a scan driving circuit, and a timing controller 20.

The display panel 10 includes data lines, scan lines (gate lines) crossing the data lines, and a plurality of pixels arranged in a matrix form. A thin film transistor (TFT) is formed at each of crossings of the data lines and the scan lines.

The display panel 10 may be implemented as a display panel of a flat panel display such as a liquid crystal display (LCD), a field emission display (FED), a plasma display device, an electroluminescence device (EL) including an inorganic electroluminescence element and an organic light emitting diode (OLED) element, and an electrophoretic display (EPD). If the display panel 10 is implemented as the display panel of the liquid crystal display, a backlight unit is necessary. The backlight unit may be implemented as a direct type backlight unit or an edge type backlight unit. Hereinafter, the display panel 10 is described using the display panel of the liquid crystal display as an example. Other kinds of display panels may be used.

The data driving circuit includes a plurality of source driver integrated circuits (ICs) 30. The source driver ICs 30 receive digital video data RGB from the timing controller 20. The source driver ICs 30 convert the digital video data RGB into a gamma compensation voltage in response to a source timing control signal received from the timing controller 20 and generate a data voltage. The source driver ICs 30 supply the data voltage in synchronization with a scan pulse to the data lines of the display panel 10. The source driver ICs 30 may be connected to the data lines of the display panel 10 through a chip on glass (COG) process or a tape automated bonding (TAB) process.

The scan driving circuit includes a level shifter 40 and a gate-in-panel (GIP) driving circuit 50, that are connected between the timing controller 20 and the gate lines of the display panel 10. The level shifter 40 level-shifts a transistor-transistor-logic (TTL) level voltage of gate shift clocks GCLK received from the timing controller 20 to a gate high voltage VGH and a gate low voltage VGL. The GIP driving circuit 50 receives the gate shift clocks GCLK and a start voltage VST from the timing controller 20. The GIP driving circuit 50 shifts the start voltage VST in conformity with the gate shift clocks GCLK and outputs the scan pulse.

The GIP driving circuit 50 is directly formed on a lower substrate of the display panel 10 through a gate-in-panel (GIP) method. In the GIP method, the level shifter 40 is mounted on a printed circuit board (PCB). Additionally, the GIP driving circuit 50 may be connected between the scan lines of the display panel 10 and the timing controller 20 through a tape automated bonding (TAB) method.

The timing controller 20 receives the digital video data RGB from a host computer through an interface, such as a low voltage differential signaling (LVDS) interface and a transition minimized differential signaling (TMDS) interface. The timing controller 20 transfers the digital video data RGB received from the host computer to the source driver ICs 30.

The timing controller 20 receives timing signals, such as a vertical sync signal Vsync, a horizontal sync signal Hsync, a data enable signal DE, and a main clock MCLK from the host computer through a LVDS interface receiving circuit or a TMDS interface receiving circuit. The main clock MCLK is a signal having a predetermined frequency, and the data enable signal DE is a signal indicating whether or not data exists. Based on the timing signals received from the host computer, the timing controller 20 outputs a scan timing control signal for controlling the scan driving circuit. Based on the timing signals received from the host computer, the timing controller 20 outputs a data timing control signal for controlling the source driver ICs 30 and controlling a polarity of the data voltage. The timing controller 20 includes a scan timing controller 120 for outputting the scan timing control signal and a data timing controller for outputting the data timing control signal. The scan timing controller 120 is described later in detail with reference to FIG. 2.

The scan timing control signal includes the start voltage VST, the gate shift clocks GCLK, and the like. The start voltage VST is input to the GIP driving circuit 50 and controls a shift start timing. The gate shift clocks GCLK are input to the level shifter 40 and are level-shifted by the level shifter 40. The gate shift clocks GCLK are then input to the GIP driving circuit 50 and are used as clocks for shifting the start voltage VST.

The data timing control signal includes a source start pulse, a source sampling clock, a polarity control signal, a source output enable signal, and the like. The source start pulse controls a shift start timing of the source driver ICs 30. The source sampling clock controls a sampling timing of data inside the source driver ICs 30 based on a rising or falling edge thereof. The polarity control signal controls a polarity of the data voltage output from the source driver ICs 30. If a data transfer interface between the timing controller 20 and the source driver ICs 30 is a mini LVDS interface standard, the source start pulse and the source sampling clock may be omitted.

Figure 2:
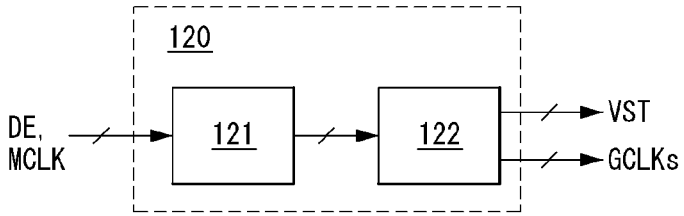
FIG. 2 is a block diagram of a timing controller shown in FIG. 1.

FIG. 2 is a block diagram of the scan timing controller 120 of the timing controller 20 shown in FIG. 1. As shown in FIG. 2, the scan timing controller 120 includes a frequency change sensing unit 121 and a scan timing control signal output unit 122.

The frequency change sensing unit 121 receives timing signals such as the data enable signal DE, the main clock MCLK, and a VCO clock VCO CLK generated in a voltage controlled oscillator (VCO) inside or outside the timing controller 20. The frequency change sensing unit 121 measures a difference between a length of an (n−1)th frame period and a length of an nth frame period, where n is a natural number equal to or greater than 2. When the length difference between the (n−1)th frame period and the nth frame period is greater than a predetermined first threshold value, the frequency change sensing unit 121 masks the input timing signals. The masking of the signals indicates that the timing signals are output as a signal having a low logic level (or "0"). When a count value of the data enable signals generated during the (n−1)th frame period is greater than a predetermined second threshold value and a count value of the data enable signals generated during the nth frame period is greater than the predetermined second threshold value, the frequency change sensing unit 121 outputs the input timing signals without changes thereof The scan timing control signal output unit 122 outputs the scan timing control signal based on the timing signals output from the frequency change sensing unit 121. The scan timing control signal includes the start voltage VST and the gate shift clocks GCLK.

The frequency change sensing unit 121 of the scan timing controller 120 is described below in detail with reference to FIGS. 3 and 4.

Figure 3:
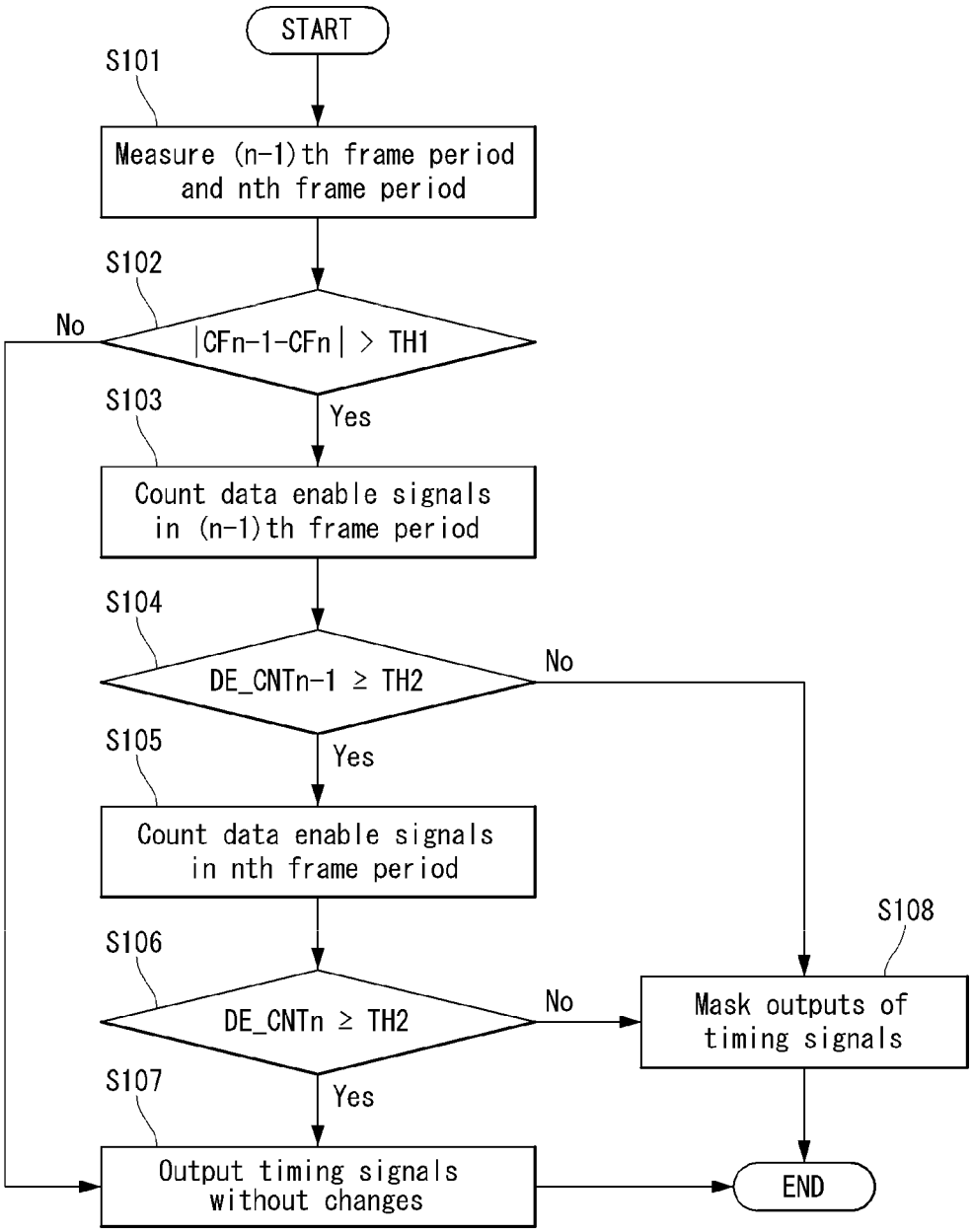
FIG. 3 is a flow chart illustrating a method for driving a timing controller according to an example embodiment of the invention.
Figure 4:
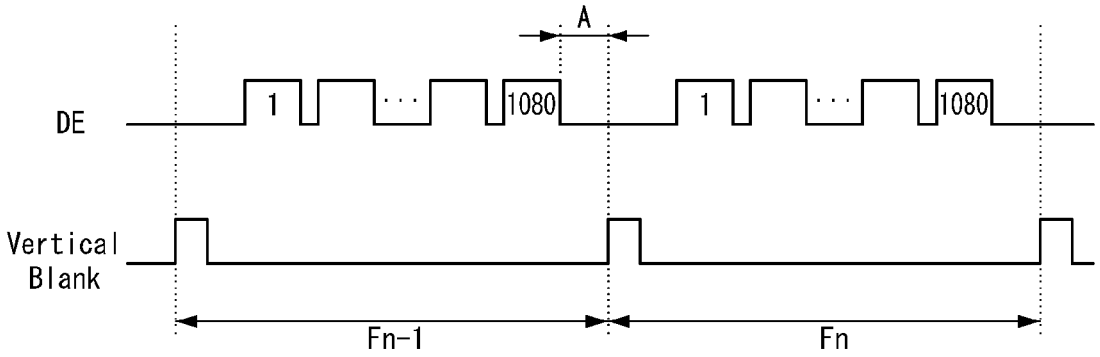
FIG. 4 is a waveform diagram illustrating a data enable signal and a vertical blank signal of a frequency change sensing unit.

FIG. 3 is a flow chart illustrating a method for driving the timing controller according to the example embodiment of the invention. FIG. 4 is a waveform diagram illustrating a data enable signal and a vertical blank signal of the frequency change sensing unit. The method for driving the timing controller according to the example embodiment of the invention is described with reference to FIG. 2.

The frequency change sensing unit 121 receives the timing signals such as the data enable signal DE, the main clock MCLK, and the VCO clock VCO CLK. As shown in FIG. 4, when the data enable signal DE is not generated during a period equal to or longer than a predetermined time of period A, the frequency change sensing unit 121 generates a vertical blank signal after the predetermined time of period A. The frequency change sensing unit 121 decides a period ranging from a generation start time point of one vertical blank signal to a generation start time point of a next vertical blank signal as one frame period.

The frequency change sensing unit 121 measures a difference between a length of an (n−1)th frame period Fn−1 and a length of an nth frame period Fn. As shown in FIG. 3, the frequency change sensing unit 121 counts the number of main clocks MCLK or VCO clocks VCO CLK generated during the (n−1)th frame period Fn−1 and counts the number of main clocks MCLK or VCO clocks VCO CLK generated during the nth frame period Fn in step S101.

The frequency change sensing unit 121 calculates a difference between a count value CFn−1 of the (n−1)th frame period Fn−1 and a count value CFn of the nth frame period Fn, thereby measuring the length difference between the (n−1)th frame period Fn−1 and the nth frame period Fn using the count value difference. The frequency change sensing unit 121 decides whether or not the difference between the count value CFn−1 of the (n−1)th frame period Fn−1 and the count value CFn of the nth frame period Fn is greater than a predetermined first threshold value TH1, as indicated by the following Equation 1, in step S102. The predetermined first threshold value TH1 may be determined as a value capable of deciding the length difference between the (n−1)th frame period Fn−1 and the nth frame period Fn and may be determined through a preliminary experiment.

$$|CFn-1-CFn|>TH1 \quad \text{[Equation1]}$$

As shown in FIG. 3, when the difference between the count value CFn−1 of the (n−1)th frame period Fn−1 and the count value CFn of the nth frame period Fn is equal to or less than the predetermined first threshold value TH1, the frequency change sensing unit 121 outputs the timing signals without changes in the timing signals in step S107. On the other hand, when the difference between the count value CFn−1 of the (n−1)th frame period Fn−1 and the count value CFn of the nth frame period Fn is greater than the predetermined first threshold value TH1, the frequency change sensing unit 121 counts the number of data enable signals DE generated during the (n−1)th frame period Fn−1 in step S103.

As shown in FIG. 3, the frequency change sensing unit 121 decides whether or not a count value DE_CNTn−1 of the data enable signals DE in the (n−1)th frame period Fn−1 is equal to or greater than a predetermined second threshold value TH2, as indicated by the following Equation 2, in step S104.

$$DE-CNT_{n-1}\geq TH2 \quad \text{[Equation 2]}$$

When the count value DE_CNTn−1 of the data enable signal DE in the (n−1)th frame period Fn−1 is less than the predetermined second threshold value TH2, the frequency change sensing unit 121 masks outputs of the timing signals in step S108. Namely, the frequency change sensing unit 121 outputs the timing signals of the low logic level.

On the other hand, when the count value DECNTn−1 of the data enable signal DE in the (n−1)th frame period Fn−1 is equal to or greater than the predetermined second threshold value TH2, the frequency change sensing unit 121 counts the number of data enable signals DE generated during the nth frame period Fn in step S105.

As shown in FIG. 3, the frequency change sensing unit 121 decides whether or not a count value DE_CNTn of the data enable signals DE in the nth frame period Fn is equal to or greater than the predetermined second threshold value TH2, as indicated by the following Equation 3, in step S106. The predetermined second threshold value TH2 may be determined as a value capable of deciding the (n−1)th frame period Fn−1 and the nth frame period Fn as one frame period and may be set to the number of vertical lines of the display panel 10. This is because the data enable signals corresponding to the number of vertical lines of the display panel 10 are generated during one frame period. Further, the predetermined second threshold value TH2 may vary depending on a resolution of the display panel 10 and may be determined through a preliminary experiment.

$$DE-CNT_{n}\geq TH2 \quad \text{[Equation 3]}$$

When the count value DE_CNTn of the data enable signals DE in the nth frame period Fn is less than the predetermined second threshold value TH2, the frequency change sensing unit 121 masks outputs of the timing signals in step S108. Namely, the frequency change sensing unit 121 outputs the timing signals of the low logic level.

On the other hand, when the count value DE_CNTn of the data enable signals DE in the nth frame period Fn is equal to or greater than the predetermined second threshold value TH2, the frequency change sensing unit 121 outputs the timing signals without changes in the timing signals in step S107.

In other words, when the length difference between the (n−1)th frame period and the nth frame period is greater than the predetermined first threshold value TH1, the frequency change sensing unit 121 decides that there is change in the frequency of the timing signals. However, when the count value DECNTn−1 of the data enable signals DE in the (n−1)th frame period Fn−1 is less than the predetermined second threshold value TH2 or the count value DE_CNTn of the data enable signals DE in the nth frame period Fn is less than the predetermined second threshold value TH2, the frequency change sensing unit 121 decides that there is no change in the frequency of the timing signals.

A general frequency change generates the problem because the data enable signals DE are not generated as many vertical lines of the display panel 10 during one frame period.

On the other hand, a frame frequency change between a national television system committee (NTSC) scheme and a phase alternate line (PAL) scheme does not matter because the data enable signals DE are generated as many vertical lines of the display panel 10 during one frame period. Because a normal output may be performed in the frame frequency change between the NTSC scheme and the PAL scheme, the frame frequency change does not matter. Accordingly, in the embodiment of the invention, when the data enable signals DE are generated as many vertical lines of the display panel 10 during one frame period, the input signals are not masked. As a result, the embodiment of the invention may prevent an abnormal output resulting from the frequency change. Further, because the embodiment of the invention does not recognize the frame frequency change between the NTSC scheme and the PAL scheme as the frequency change, the normal output may be generated. An input frame frequency is 50 Hz in the PAL scheme and 60 Hz in the NTSC scheme.

Figure 5A:
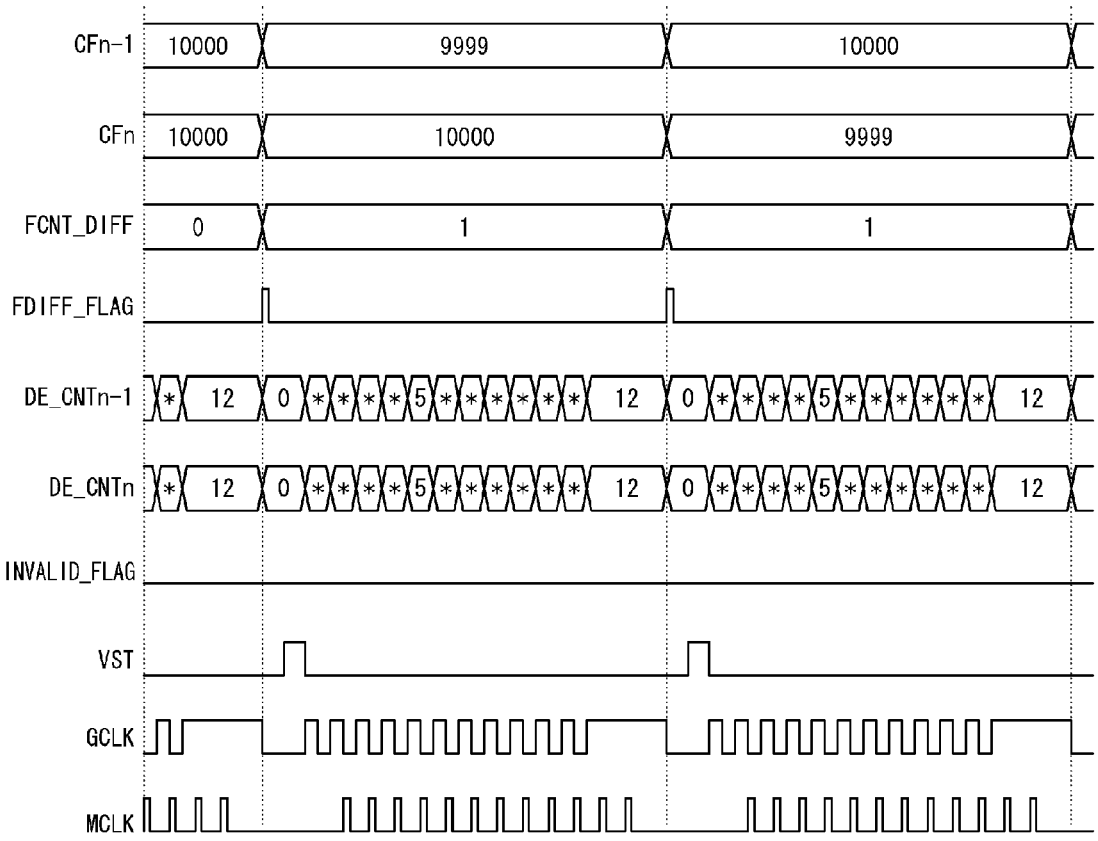
FIGS. 5A and 5B are waveform diagrams illustrating simulation results of an example embodiment of the invention.
Figure 5B:
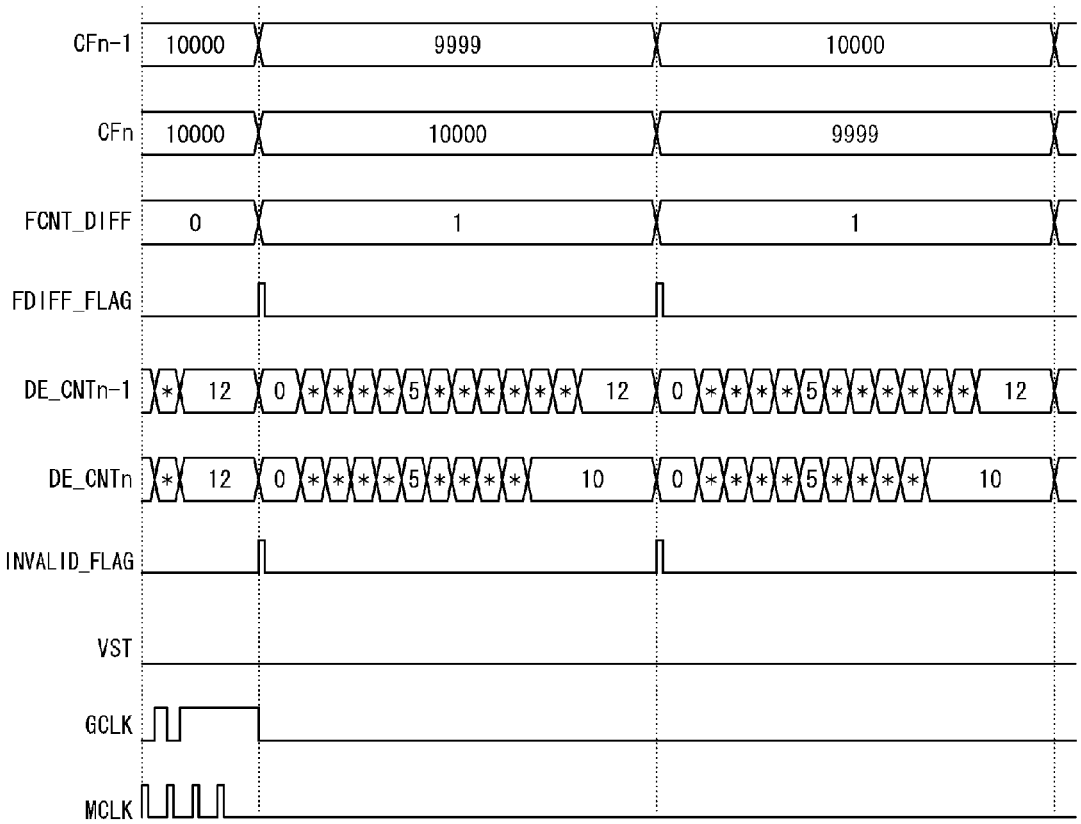

FIGS. 5A and 5B are waveform diagrams illustrating simulation results of the example embodiment of the invention. More specifically, FIG. 5A illustrates the signals, that are not masked by the frequency change sensing unit 121, and FIG. 5B illustrates the signals masked by the frequency change sensing unit 121.

In FIGS. 5A and 5B, CFn−1 denotes a count value of the VCO clocks VCO CLK generated during the (n−1)th frame period Fn−1, CFn denotes a count value of the VCO clocks VCO CLK generated during the nth frame period Fn. FCNT_DIFF denotes a difference between the count value CFn−1 of the (n−1)th frame period Fn−1 and the count value CFn of the nth frame period Fn, and FDIFF_FLAG denotes a signal generated when the difference FCNT_DIFF between the count value CFn−1 of the (n−1)th frame period Fn−1 and the count value CFn of the nth frame period Fn is greater than the predetermined first threshold value TH1. Further, DE_CNTn−1 denotes a count value of the data enable signals DE generated during the (n−1)th frame period Fn−1, DE_CNTn denotes a count value of the data enable signals DE generated during the nth frame period Fn, and INVALID_FLAG denotes a signal generated when the count value DE_CNTn−1 of the data enable signals DE in the (n−1)th frame period Fn−1 is less than the predetermined second threshold value TH2 or the count value DE_CNTn of the data enable signals DE in the nth frame period Fn is less than the predetermined second threshold value TH2. Further, 'VST' denotes the start voltage, 'GCLK' denotes the gate shift clock, and 'MCLK' denotes the main clock.

As shown in FIG. 5A, the frequency change sensing unit 121 counts the number of VCO clocks VCO CLK generated during the (n−1)th frame period Fn−1 and counts the number of VCO clocks VCO CLK generated during the nth frame period Fn. The frequency change sensing unit 121 calculates the difference FCNT_DIFF between the count value CFn−1 of the (n−1)th frame period Fn−1 and the count value CFn of the nth frame period Fn. When the difference FCNT_DIFF is greater than the predetermined first threshold value TH1, the frequency change sensing unit 121 generates the difference FCNT_DIFF as '1' and generates the signal FDIFF_FLAG. The frequency change sensing unit 121 counts the number of data enable signals DE generated during the (n−1)th frame period Fn−1 and counts the number of data enable signals DE generated during the nth frame period Fn. FIG. 5A illustrates an example where 12 data enable signals DE are generated during one frame period. Thus, the count value DE CNTn−1 of the data enable signals DE in the (n−1)th frame period Fn−1 is '12', and the count value DE_CNTn of the data enable signals DE in the nth frame period Fn is '12'. Because both the count value DE_CNTn−1 of the data enable signals DE in the (n−1)th frame period Fn−1 and the count value DE_CNTn of the data enable signals DE in the nth frame period Fn are equal to or greater than the predetermined second threshold value TH2, the frequency change sensing unit 121 does not generate the signal INVALID FLAG. Thus, the frequency change sensing unit 121 outputs the input timing signals without changes, and the scan timing control signal output unit 122 normally outputs the scan timing control signal such as the start voltage VST and the gate shift clock GCLK.

As shown in FIG. 5B, the frequency change sensing unit 121 counts the number of VCO clocks VCO CLK generated during the (n−1)th frame period Fn−1 and counts the number of VCO clocks VCO CLK generated during the nth frame period Fn. The frequency change sensing unit 121 calculates the difference FCNT DIFF between the count value CFn−1 of the (n−1)th frame period Fn−1 and the count value CFn of the nth frame period Fn. When the difference FCNT_DIFF is greater than the predetermined first threshold value TH1, the frequency change sensing unit 121 generates the difference FCNT_DIFF as '1' and generates the signal FDIFF_FLAG. The frequency change sensing unit 121 counts the number of data enable signals DE generated during the (n−1)th frame period Fn−1 and counts the number of data enable signals DE generated during the nth frame period Fn. FIG. 5B illustrates an example where 12 data enable signals DE are generated during one frame period. Thus, the count value DE CNTn−1 of the data enable signals DE in the (n−1)th frame period Fn−1 is '12', and the count value DE_CNTn of the data enable signals DE in the nth frame period Fn is '10'. Because the count value DE CNTn−1 of the data enable signals DE in the (n−1)th frame period Fn−1 is equal to or greater than the predetermined second threshold value TH2 and the count value DE_CNTn of the data enable signals DE in the nth frame period Fn is less than the predetermined second threshold value TH2, the frequency change sensing unit 121 generates the signal INVALID_FLAG. Thus, the frequency change sensing unit 121 masks the outputs of the input timing signals and outputs the input timing signals of the low (or '1') logic level. Further, the scan timing control signal output unit 122 outputs the scan timing control signal such as the start voltage VST and the gate shift clock GCLK at the low (or '1') logic level.

So far, the example embodiment of the invention described the flat panel display of the GIP manner. Other manners may be used. For example, in a flat panel display using gate driver ICs, when the frequency change sensing unit 121 senses the frequency change, the scan timing control signal output unit 122 may output a gate output enable signal of a high (or '1') logic level.

As described above, the display device according to the example embodiment of the invention outputs the input timing signals of the low logic level when there is a length difference between the (n−1)th frame period and the nth frame period Fn. As a result, the display device according to the example embodiment of the invention can prevent the abnormal output resulting from the frequency change. Further, the display device according to the example embodiment of the invention outputs the input timing signals without changes when both the count value of the data enable signals in the (n−1)th frame period and the count value of the data enable signals in the nth frame period are equal to or greater than the predetermined second threshold value. As a result, because the display device according to the example embodiment of the invention does not recognize the frame frequency change between the NTSC scheme and the PAL scheme as the frequency change, the display device according to the example embodiment of the invention can perform the normal output.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A timing controller, comprising:

a frequency change sensing unit configured to measure a length of an (n−1)th frame period and a length of an nth frame period, where n is a natural number equal to or greater than 2, and output timing signals of a low logic level when a difference between the length of the (n−1)th frame period and the length of the nth frame period is greater than a predetermined first threshold value;

a scan timing control signal output unit configured to output a scan timing control signal for controlling a scan driving circuit of a display panel based on the timing signals output from the frequency change sensing unit; and a data timing control signal output unit configured to control a data driving circuit of the display panel and a polarity of a data voltage based on the timing signals received from a host computer, wherein the timing signals include a data enable signal indicating whether or not data having a predetermined frequency exists, a main clock having a predetermined frequency, and an internal clock having a predetermined frequency.

wherein when a count value of the number of data enable signals generated during the (n−1)th frame period and a count value of the number of data enable signals generated during the nth frame period are equal to or greater than a predetermined second threshold value, the frequency change sensing unit outputs the timing signals without changes in the timing signals.

2. The timing controller of claim 1, wherein the scan timing control signal includes a start voltage and gate shift clocks.

3. The timing controller of claim 1, wherein the frequency change sensing unit counts the number of main clocks or internal clocks generated during the (n−1)th frame period, counts the number of main clocks or internal clocks generated during the nth frame period, and measures the length of the (n−1)th frame period and the length of the nth frame period.

4. The timing controller of claim 3, wherein the internal clock is a VCO clock generated in a voltage controlled oscillator (VCO).

5. A display device comprising:

a display panel including data lines and scan lines crossing the data lines;

a scan driving circuit configured to sequentially output a scan pulse to the scan lines;

a data driving circuit configured to convert digital video data into a data voltage and supply the data voltage to the data lines in synchronization with the scan pulse; and a timing controller configured to control an output timing of the scan driving circuit and an output timing of the data driving circuit, the timing controller including:

a frequency change sensing unit configured to measure a length of an (n−1)th frame period and a length of an nth frame period, where n is a natural number equal to or greater than 2, and output timing signals of a low logic level when a difference between the length of the (n−1)th frame period and the length of the nth frame period is greater than a predetermined first threshold value;

a scan timing control signal output unit configured to output a scan timing control signal for controlling the scan driving circuit based on the timing signals output from the frequency change sensing unit; and a data timing control signal output unit configured to control the data driving circuit and a polarity of the data voltage based on the timing signals received from a host computer, wherein the timing signals include a data enable signal indicating whether or not data having a predetermined frequency exists, a main clock having a predetermined frequency, and an internal clock having a predetermined frequency. wherein when a count value of the number of data enable signals generated during the (n−1)th frame period and a count value of the number of data enable signals generated during the nth frame period are equal to or greater than a predetermined second threshold value, the frequency change sensing unit outputs the timing signals without changes in the timing signals.

6. The display device of claim 5, wherein the scan timing control signal includes a start voltage and gate shift clocks.

7. The display device of claim 5, wherein the frequency change sensing unit counts the number of main clocks or internal clocks generated during the (n−1)th frame period, counts the number of main clocks or internal clocks generated during the nth frame period, and measures the length of the (n−1)th frame period and the length of the nth frame period.

8. The display device of claim 7, wherein the internal clock is a VCO clock generated in a voltage controlled oscillator (VCO).

9. The display device of claim 5, wherein the display panel is implemented as one of display panels of a liquid crystal display, a field emission display, a plasma display device, an electroluminescence device including an inorganic electroluminescence element and an organic light emitting diode element, and an electrophoretic display.

10. A method for driving a timing controller comprising:

measuring a length of an (n−1)th frame period and a length of an nth frame period, where n is a natural number equal to or greater than 2, and outputting timing signals of a low logic level when a difference between the length of the (n−1)th frame period and the length of the nth frame period is greater than a predetermined first threshold value;

outputting a scan timing control signal for controlling a scan driving circuit of a display panel based on the output timing signals; and controlling a data driving circuit of the display panel and a polarity of a data voltage based on the timing signals received from a host computer, wherein the timing signals include a data enable signal indicating whether or not data having a predetermined frequency exists, a main clock having a predetermined frequency, and an internal clock having a predetermined frequency, and wherein the outputting of the timing signals of the low logic level includes outputting the timing signals without changes in the timing signals when a count value of the number of data enable signals generated during the (n−1)th frame period and a count value of the number of data enable signals generated during the nth frame period are equal to or greater than a predetermined second threshold value.

11. The method of claim 10, wherein the scan timing control signal includes a start voltage and gate shift clocks.

12. The method of claim 10, wherein the outputting of the timing signals of the low logic level includes counting the number of main clocks or internal clocks generated during the (n−1)th frame period, counting the number of main clocks or internal clocks generated during the nth frame period, and measuring the length of the (n−1)th frame period and the length of the nth frame period.

13. The method of claim 12, wherein the internal clock is a VCO clock generated in a voltage controlled oscillator (VCO).

* * * * *